US010485262B1

(12) United States Patent
Whitmer

(10) Patent No.: US 10,485,262 B1
(45) Date of Patent: Nov. 26, 2019

(54) APPARATUS AND METHODS FOR FILLING CONES FOR SMOKING

(71) Applicant: Kenneth E. Whitmer, Mesa, AZ (US)

(72) Inventor: Kenneth E. Whitmer, Mesa, AZ (US)

( * ) Notice: Subject to any disclaimer, the term of this patent is extended or adjusted under 35 U.S.C. 154(b) by 400 days.

(21) Appl. No.: 15/367,760

(22) Filed: Dec. 2, 2016

Related U.S. Application Data

(60) Provisional application No. 62/263,339, filed on Dec. 4, 2015.

(51) Int. Cl.
*A24C 5/02* (2006.01)
*A24C 5/40* (2006.01)
*A24C 5/39* (2006.01)

(52) U.S. Cl.
CPC ..... *A24C 5/02* (2013.01); *A24C 5/39* (2013.01); *A24C 5/40* (2013.01)

(58) Field of Classification Search
CPC ..... A24F 13/02; A24F 13/14; A24F 15/20; A24F 21/00; B65D 85/10; B65D 85/1072
See application file for complete search history.

(56) References Cited

U.S. PATENT DOCUMENTS 1,227,608 A * 5/1917 Godfrey ..... B65D 85/1072 206/256
2,185,328 A * 1/1940 Buttermann ..... B65D 5/5425 206/499
2,330,460 A * 9/1943 Waldrip ..... A24F 13/02 131/187
4,793,478 A * 12/1988 Tudor ..... A24F 15/20 206/256
5,810,164 A * 9/1998 Rennecamp ..... B65D 85/1081 131/260
6,474,342 B1 * 11/2002 Rennecamp ..... A24F 23/04 131/241
2017/0119043 A1 * 5/2017 Swanson ..... A24C 5/42

* cited by examiner

*Primary Examiner* — Cynthia Szewczyk
(74) *Attorney, Agent, or Firm* — Michael W. Goltry; Robert A. Parsons; Parsons & Goltry, PLLC

(57) ABSTRACT

An apparatus for filling smoking cones includes a tower that projects upright from a base to an upper extremity. A first cone holder coupled to the tower defines an inverted cone-receiving first volume that extends upright from a first closed end of the first cone holder proximate to the base to a first open end of the first cone holder proximate to the upper extremity. A second cone holder coupled to the base defines an inverted cone-receiving second volume that extends upright from a second closed end of the second cone holder between the base and the upper extremity to a second open end of the second cone holder proximate to the upper extremity. A length of the first volume from the first closed end to the first open end is greater than a length of the second volume from the second closed end to the second open end.

12 Claims, 17 Drawing Sheets

10

50B
56
32
55
12B
22B
42
60B
66
65
50
56
55
60
66
65
30
50
56
55
60
66
65
40
12C
12D
66
65
60A
41
22
12
12F
55
50
56
55
50A
56
11
31
12A
22A 10
121
120
122
108
100
101
106
107
104
105
110
70
25
12B
32
50B
50
25
30
50
15
12
50
50A
11
21
71
42
60B
72B
60
72
12D
72A
60
16
60A
40
41
12A

APPARATUS AND METHODS FOR FILLING CONES FOR SMOKING

CROSS REFERENCE TO RELATED APPLICATION

This application claims the benefit of U.S. Provisional Patent Application No. 62/263,339, filed Dec. 4, 2015, the entire contents of which are incorporated herein by reference.

FIELD OF THE INVENTION

The present invention relates generally to smokers' articles and, more particularly, to apparatus and methods for filling cones for smoking.

BACKGROUND OF THE INVENTION

A smoke or smoking cone is a smoker's article consisting of a pre-rolled paper with an integrated cardboard filter. After a preselected amount of a material to be smoked, such as tobacco, is packed into the cone, the end of the cone to be lit is twist closed. The twist-closed end of the cone is ignited causing the cone and the material to be smoked to smolder allowing smoke to be inhaled from the filtered end, which is held in or to the mouth. Although cones are popular, they are difficult to pack. Accordingly, what is needed in the art are apparatus and methods useful easily, quickly, and efficiently packing smoke cones with a material to be smoked.

SUMMARY OF THE INVENTION

An apparatus for filling smoking cones includes a base, and a tower. The tower includes a lower extremity and an upper extremity, the tower projects upright from the lower extremity affixed to the base to the upper extremity. A first cone holder coupled to the tower defines a first inverted cone-receiving volume that extends upright from a closed end of the first cone holder proximate to the lower extremity of the tower to an open end of the first cone holder proximate to the upper extremity of the tower. A second cone holder coupled to the tower defines a second inverted cone-receiving volume that extends upright from a closed end of the second cone holder between the lower extremity of the tower and the upper extremity of the tower to an open end of the second cone holder proximate to the upper extremity of the tower. A first length of the first inverted cone-receiving volume from the closed end of the first cone holder to the open end of the first cone holder is greater than a second length of the second inverted cone-receiving volume from the closed end of the second cone holder to the open end of the second cone holder.

The first cone holder includes first bindings. The first bindings project outward from the tower, are spaced apart, and are axially aligned vertically from the closed end of the first cone holder to the open end of the first cone holder. A lowermost one of the first bindings proximate to the lower extremity of the tower defines the closed end of the first cone holder. An uppermost one of the first bindings proximate to the upper extremity of the tower defines the open end of the first cone holder. Each of the first bindings bounds a first receiving area. The first receiving areas are axially aligned vertically from the closed end of the first cone holder to the open end of the first cone holder. The first receiving areas bound by the first bindings and the tower extending between each first binding and an adjacent first binding together define the first inverted cone-receiving volume from the closed end of the first cone holder to the open end of the first cone holder.

The second cone holder includes second bindings. The second bindings project outward from the tower, are spaced apart, and are axially aligned vertically from the closed end of the second cone holder to the open end of the second cone holder. A lowermost one of the second bindings between the lower extremity of the tower and the upper extremity of the tower defines the closed end of the second cone holder. An uppermost one of the second bindings proximate to the upper extremity of the tower defines the open end of the second cone holder. Each of the second bindings bounds a second receiving area. The second receiving areas are axially aligned vertically from the closed end of the second cone holder to the open end of the second cone holder. The second receiving areas bound by the second bindings and the tower extending between each second binding and an adjacent second binding together define the second inverted cone-receiving volume from the closed end of the second cone holder to the open end of the second cone holder.

The first receiving areas enlarge progressively from the lowermost one of the first bindings to the uppermost one of the first bindings. The second receiving areas enlarge progressively from the lowermost one of the second bindings to the uppermost one of the second bindings.

The first bindings are parallel relative to each other. The second bindings are parallel relative to each other. The first bindings and the second bindings project outwardly from the tower in opposite directions. The first bindings are parallel relative to the second bindings. The first bindings are U-shaped. The second bindings are U-shaped.

There is also a tray. The tray includes a spout and a pin on either side of a catch. The spout extends into the open end of the first cone holder, the pin extends into the open end of the second cone holder, and the catch engages the upper extremity of the tower restricting rotation of the tray relative to the tower, when the tray is set atop the upper extremity of the tower in a first cone-filling position. The spout extends into the open end of the second cone holder, the pin extends into the open end of the first cone holder, and the catch engages the upper extremity of the tower restricting rotation of the tray relative to the tower, when the tray is set atop the upper extremity of the tower in a second cone-filling position.

BRIEF DESCRIPTION OF THE DRAWINGS

Referring to the drawings.

DETAILED DESCRIPTION

Figure 1:
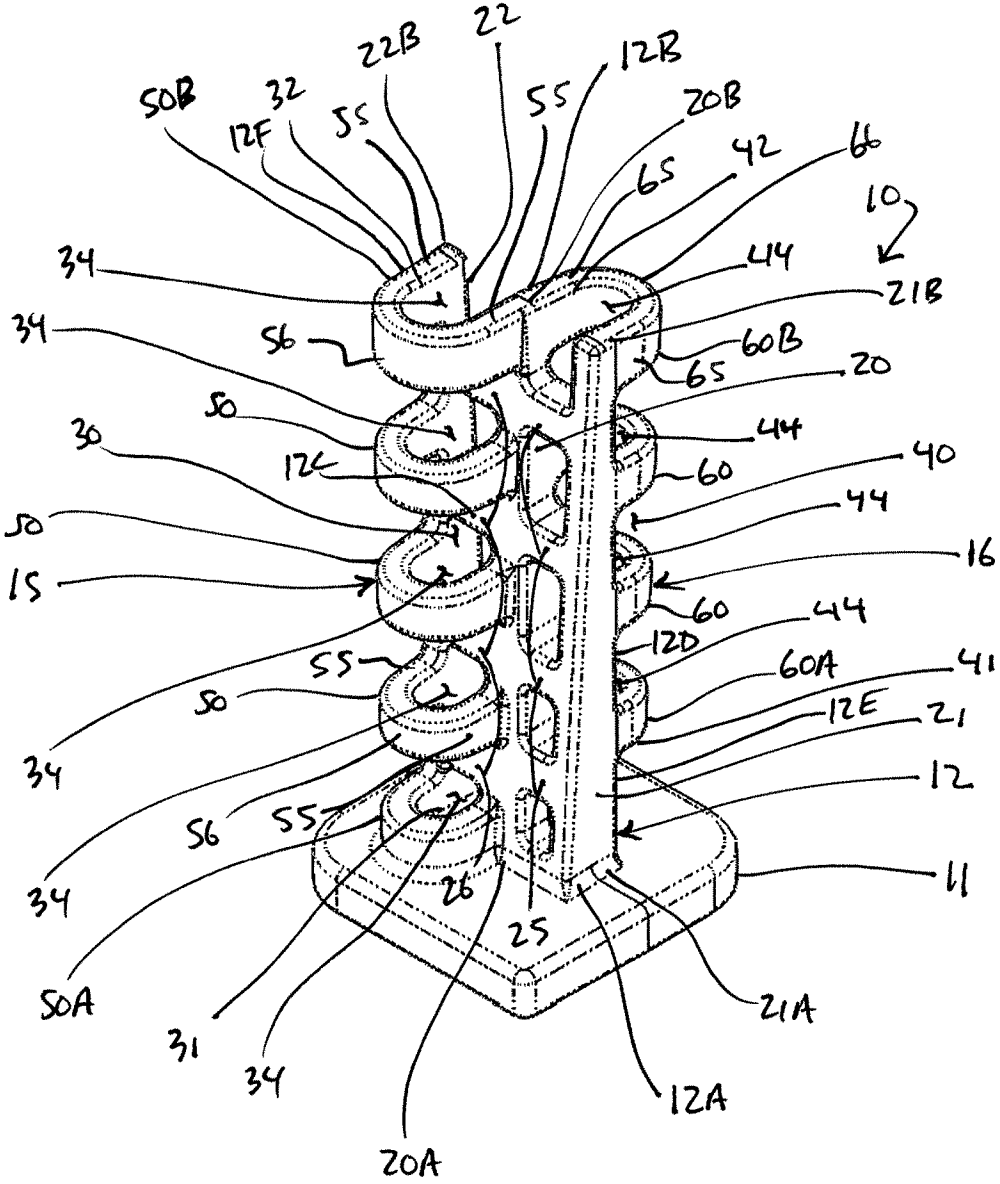
FIG. 1 is a front perspective view of a cone-filling apparatus useful for holding cones inverted for filling with a material to be smoked, the cone-filling apparatus including minor and major cone holders.
Figure 2:
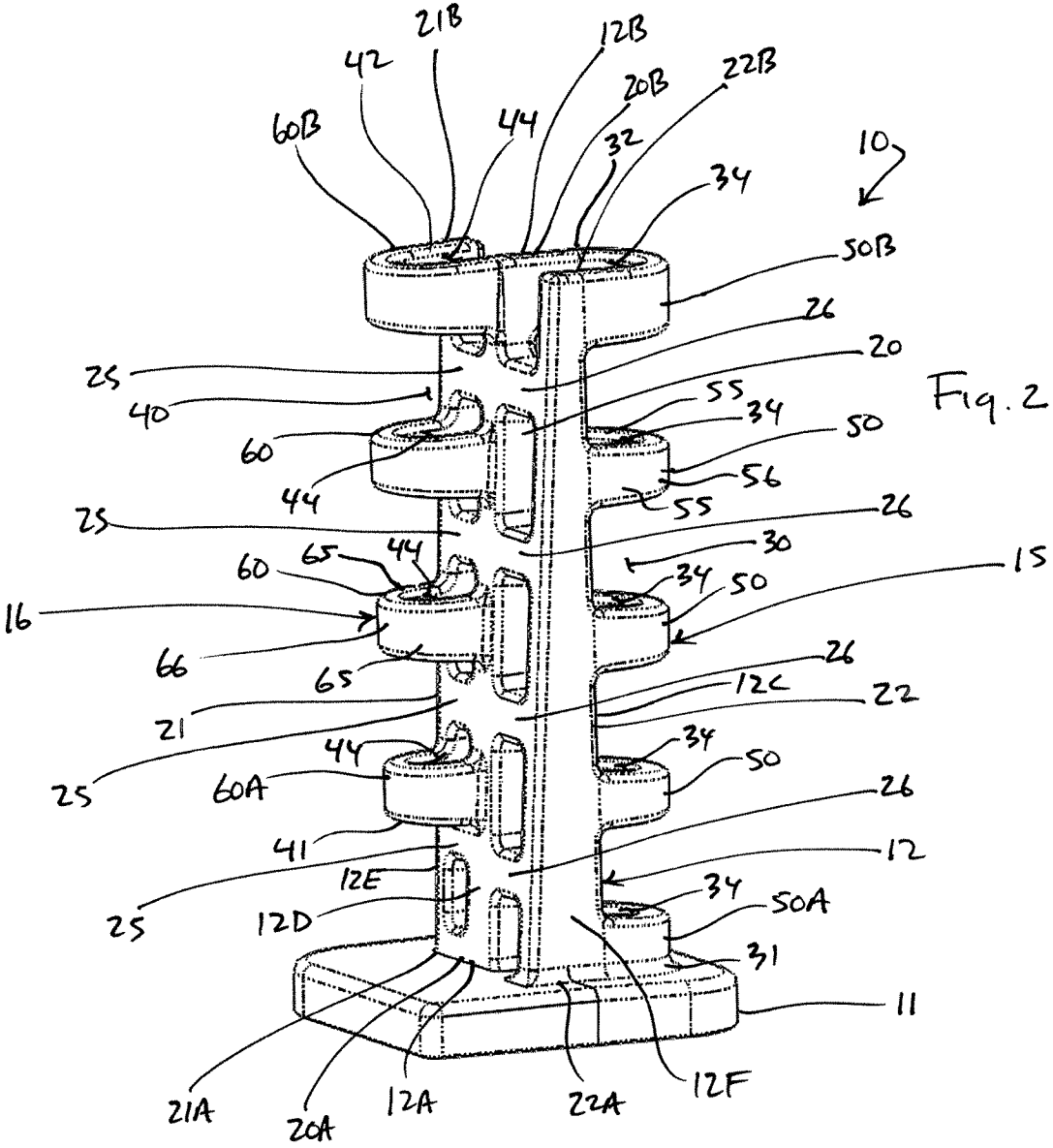
FIG. 2 is a rear perspective view of the embodiment of FIG. 1.
Figure 3:
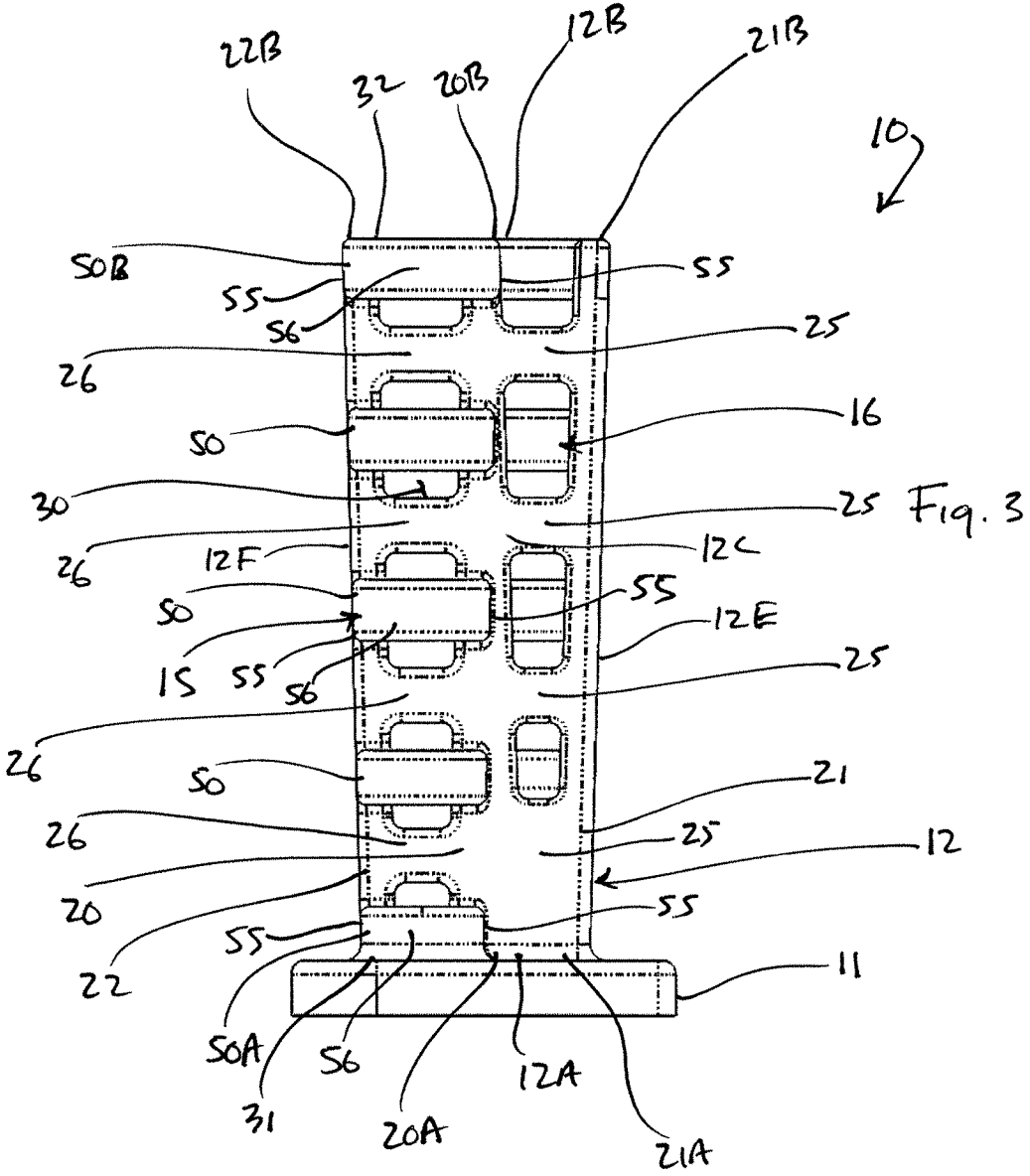
FIG. 3 is a front elevation view of the embodiment of FIG. 1.
Figure 4:
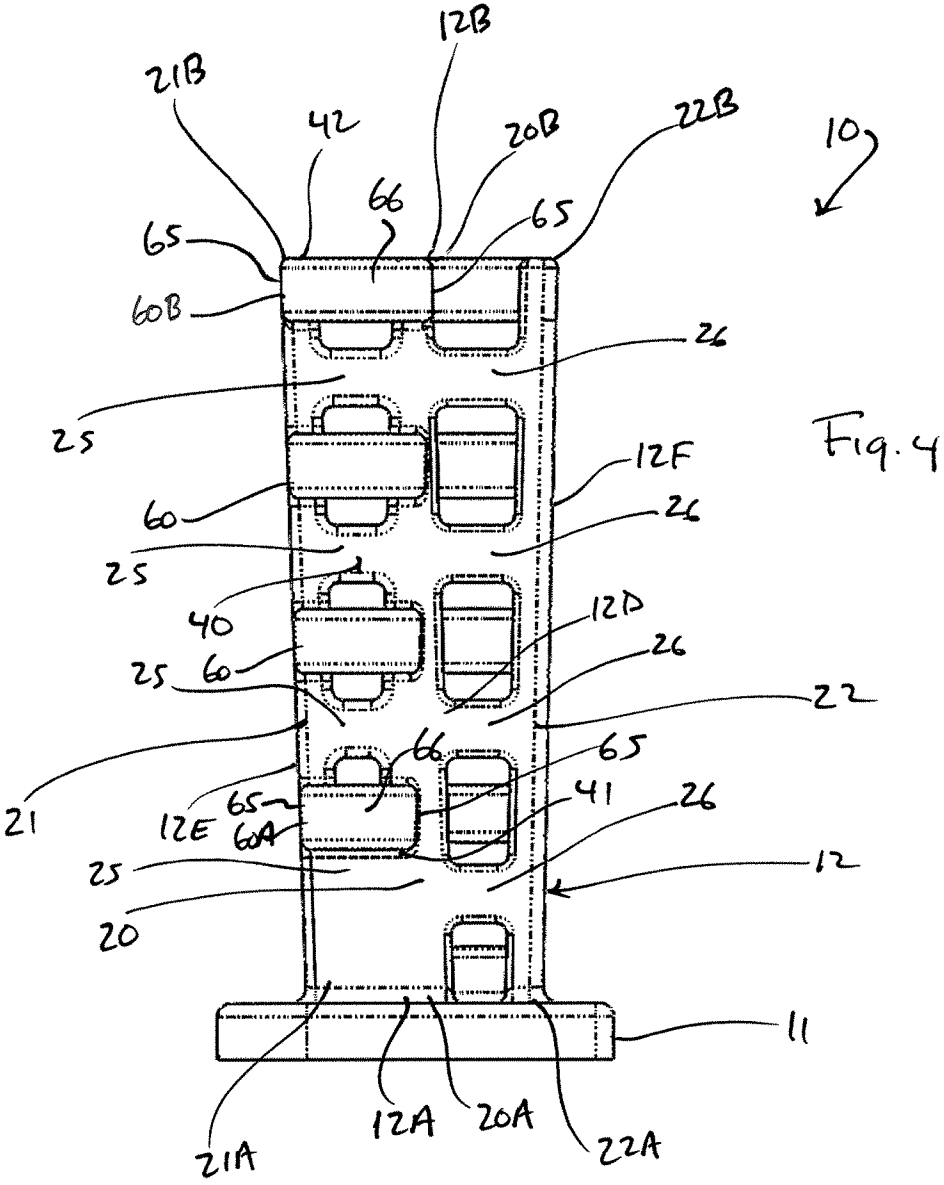
FIG. 4 is a rear elevation view of the embodiment of FIG. 1.
Figure 5:
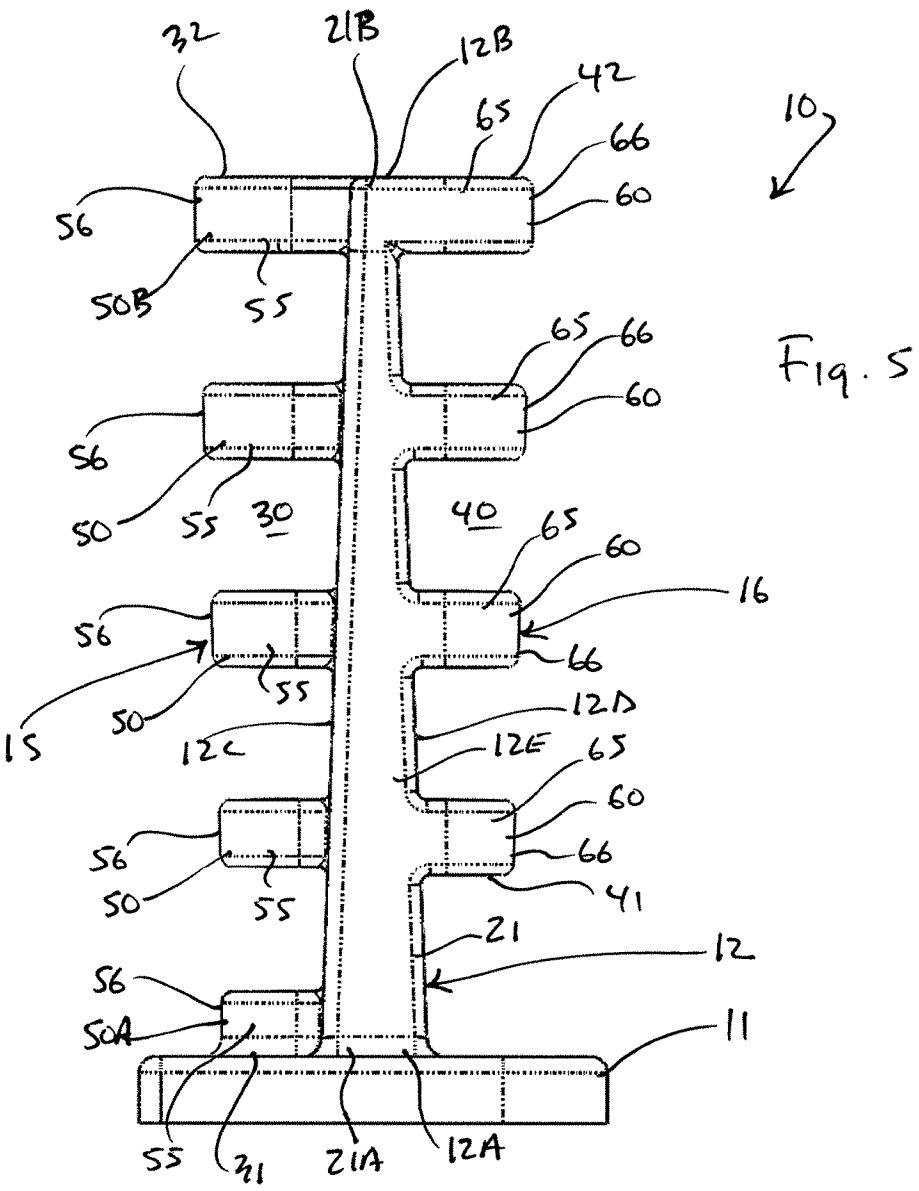
FIG. 5 is a left side elevation view of the embodiment of FIG. 1.
Figure 6:
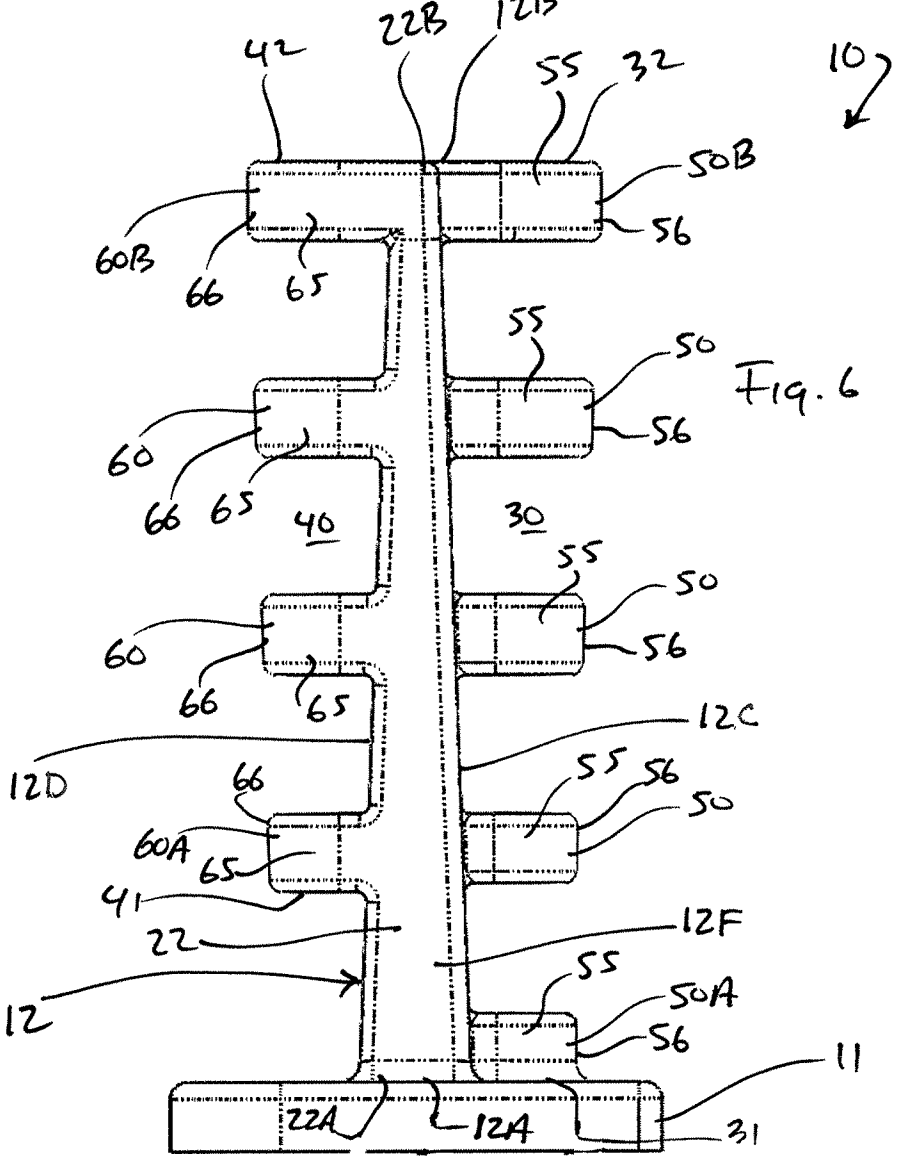
FIG. 6 is a right side elevation view of the embodiment of FIG. 1.
Figure 7:
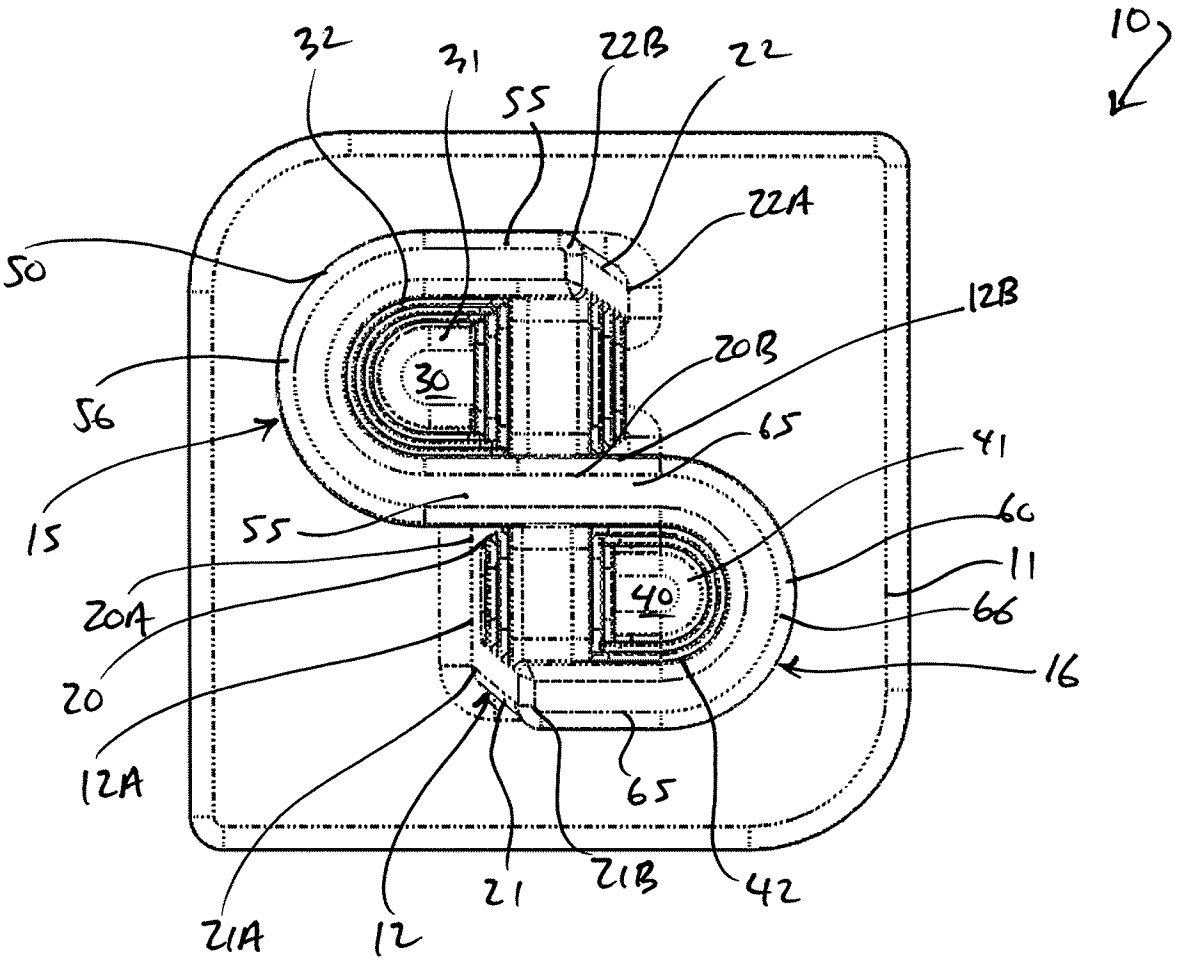
FIG. 7 is a top plan view of the embodiment of FIG. 1.

Disclosed herein is a smokers' article in the nature of a cone-filling apparatus useful for filling pre-rolled cones, known in the art as smoke or smoking cones, with material to be lawfully smoked, such tobacco or herbs for smoking. The cones are pre-formed and are readily available and are fashioned of paper. The narrowed end of each cone is the filtered end formed by a stiffened filter insert, which is the end that the smoker places into his mouth during smoking. In general, the apparatus includes a tower that extends upright from a base. The tower includes opposed cone holders. Each cone holder consists of axially-spaced binders that project outward from the tower. The binders bound receiving areas sized to receive a cone. The binders of each cone holder and the tower cooperate to define a cone-receiving volume corresponding to the inverted shape of the cone. The cones are held inverted and upright in the cone holders, which enables a user to easily fill the cones through their open circular sections at the top of the tower. Each cone holder has an uppermost loop that at least partially encircles and supports the open end of the cone for preventing damage to the open end of the cone during filling. One binder of each cone holder is aligned with the outer end of the filter insert when a cone is applied to the cone-receiving volume, which prevents the cone from buckling at the joint between the outer end of filter insert and the cone. Also provided is a tray having a spout. The tray can be set upon the top of the tower with the spout inserted into the open end of a cone to be filled. The smoker can fill the tray with tobacco, and can pack the tobacco into the open end of the cone through the spout using a supplied implement that detaches from the tray.

Referring to FIGS. 1-7 in relevant part, a cone-filling apparatus 10 includes a base 11, a tower 12, and cone holders 15 and 16. Base 11 is broad and flat and is designed to be set upon a support surface. Tower 12 includes a lower extremity 12A and an upper extremity 12B. Tower 12 projects upright from lower extremity 12A, the bottom of tower 12, affixed to base 11 to upper extremity 12B, the top of tower 12.

Tower 12 includes upright, parallel stanchions, including central stanchion 20 and opposed side stanchions 21 and 22 on either side of central stanchion 20. Central stanchion 20 includes lower end 20A attached to base 11, and extends upright therefrom to upper end 20B. Side stanchion 21 includes lower end 21A attached to base 11, and extends upright therefrom to upper end 21B. Side stanchion 22 includes lower end 22A attached to base 11, and extends upright therefrom to upper end 22B. Lower ends 20A, 21A, and 22A cooperate to define lower extremity 12A. Upper ends 20B, 21B, and 22B cooperate to define upper extremity 12B. Horizontal, parallel rails or members 25 spaced apart from lower extremity 12A to upper extremity 12B interconnect central stanchion 20 and side stanchion 21. Members 25 act as braces, and are axially spaced apart from base 11 to upper ends 20B and 21B of central and side stanchions 20 and 21, respectively. Horizontal, parallel rails or members 26 interconnect central stanchion 20 and side stanchion 22. Members 26 act as braces and are axially spaced apart from base 11 to upper ends 20B and 22B of central and side stanchions 20 and 22, respectively. Central stanchion 20, side stanchion 21, and side stanchion 22 are equal in length. Central stanchion 20, side stanchion 21, side stanchion 22, and members 25 and 26 together form tower 12. Tower 12 defines front 12C and back 12D that extend between side 12E, which is side of station 21, to side 12F, which is the side of stanchion 22.

Cone holder 15 is coupled to tower 12. Cone holder 15 defines an inverted cone-receiving volume 30 that extends upright from a closed end 31 of cone holder 15 proximate to base 11 and lower extremity 12A of tower 12 to an open end 32 of cone holder 15 proximate to upper extremity 12B of tower 12.

Cone holder 16 is coupled to tower 12. Cone holder 16 defines an inverted cone-receiving volume 40 that extends upright from a closed end 41 of cone holder 16 between lower extremity 12A and upper extremity 12B of tower 12 to an open end 42 of cone holder 16 proximate to upper extremity 12B of tower 12.

Volume 30 has a length from closed end 31 to open end 32, volume 40 has a length from closed end 41 to open end 42, and the length of volume 30 is greater than the length of volume 40. Cone holder 15 is sized to receive an inverted smoking cone having a length corresponding to the length of volume 30, and cone holder 16 is sized to receive an inverted smoking cone having a length corresponding to the length of volume 40. Because volume 40 is sized to receive an inverted smoking cone that is longer than the smoking cone volume 40 is designed to receive, cone holder 15 is a major cone holder and cone holder 16 is a minor cone holder.

Cone holder 15 includes bindings 50. Bindings 50 project outward from front 12B of tower 12, are spaced apart, and are axially aligned vertically from the closed end 31 of cone holder 15 proximate to lower extremity 12A and base 11 to open end 32 of cone holder 15. Bindings 50 include a lowermost binding 50A proximate to lower extremity 12A of base 11, an uppermost binding 50B proximate to upper extremity 12A, and three bindings 50 therebetween. Lowermost binding 50A defines closed end 31 of cone holder 15. Uppermost binding 50B defines open end 32 of cone holder 15. Each binding 50 bounds a receiving area 34. Receiving areas 34 are axially aligned vertically from closed end 31 to open end 32. Receiving areas 34 and the front of each member 25 that extends between each binding 50 and an adjacent binding 50 together define volume 30 from closed end 31 to open end 32. Receiving areas 34 are progressively smaller from uppermost binding 50B to lowermost binding 50A. Receiving areas 34 and the fronts of members 25 gradually taper downwardly from open end 32 of cone holder 15 to closed end 31 of cone holder 15 so as to define the inverted cone shape of cone holder 15 and, more specifically, of volume 30. In other words, receiving areas 34 enlarge progressively from lowermost binding 50A to uppermost binding 50B. Receiving areas 34 and the fronts of members 25 gradually diverge upwardly from closed end 31 to open end 32 of cone holder 15 so as to define the inverted cone shape of cone holder 15 and, more specifically, of volume 30.

Cone holder 16 includes bindings 60. Bindings 60 project outward from back 12C of tower 12, are spaced apart, and are axially aligned vertically from the closed end 41 of cone holder 16 proximate to lower extremity 12A and base 11 to open end 42 of cone holder 16. Bindings 60 include a lowermost binding 60A between upper extremity 12B and both lower extremity 12A and base 11, an uppermost binding 60B proximate to upper extremity 12A, and two bindings 60 therebetween. Lowermost binding 60A has a closed bottom that defines closed end 41 of cone holder 16. Uppermost binding 60B defines open end 42 of cone holder 16. Each binding 60 bounds a receiving area 44. Receiving areas 44 are axially aligned vertically from closed end 41 to open end 42. Receiving areas 44 and the back of each member 26 that extends between each binding 60 and an adjacent binding 60 together define volume 40 from closed end 41 to open end 42. Receiving areas 44 are progressively smaller from uppermost binding 60B to lowermost binding 60A. Receiving areas 44 and the backs of members 26 gradually taper downwardly from open end 42 of cone holder 16 to closed end 41 of cone holder 16 so as to define the inverted cone shape of cone holder 16 and, more specifically, of volume 40. In other words, receiving areas 44 enlarge progressively from lowermost binding 60A to uppermost binding 60B. Receiving areas 44 and the backs of members 26 gradually diverge upwardly from closed end 41 to open end 42 of cone holder 16 so as to define the inverted cone shape of cone holder 16 and, more specifically, of volume 40.

Bindings 50 are parallel relative to each other. Bindings 60 are also parallel relative to each other. Bindings 50 and bindings 60 project outwardly from tower 12 in opposite directions, bindings 50 from front 12B of tower 12, and bindings 60 from back 12C of tower 12. Bindings 50 are parallel relative to bindings 60.

Figures 22, 23, 24:
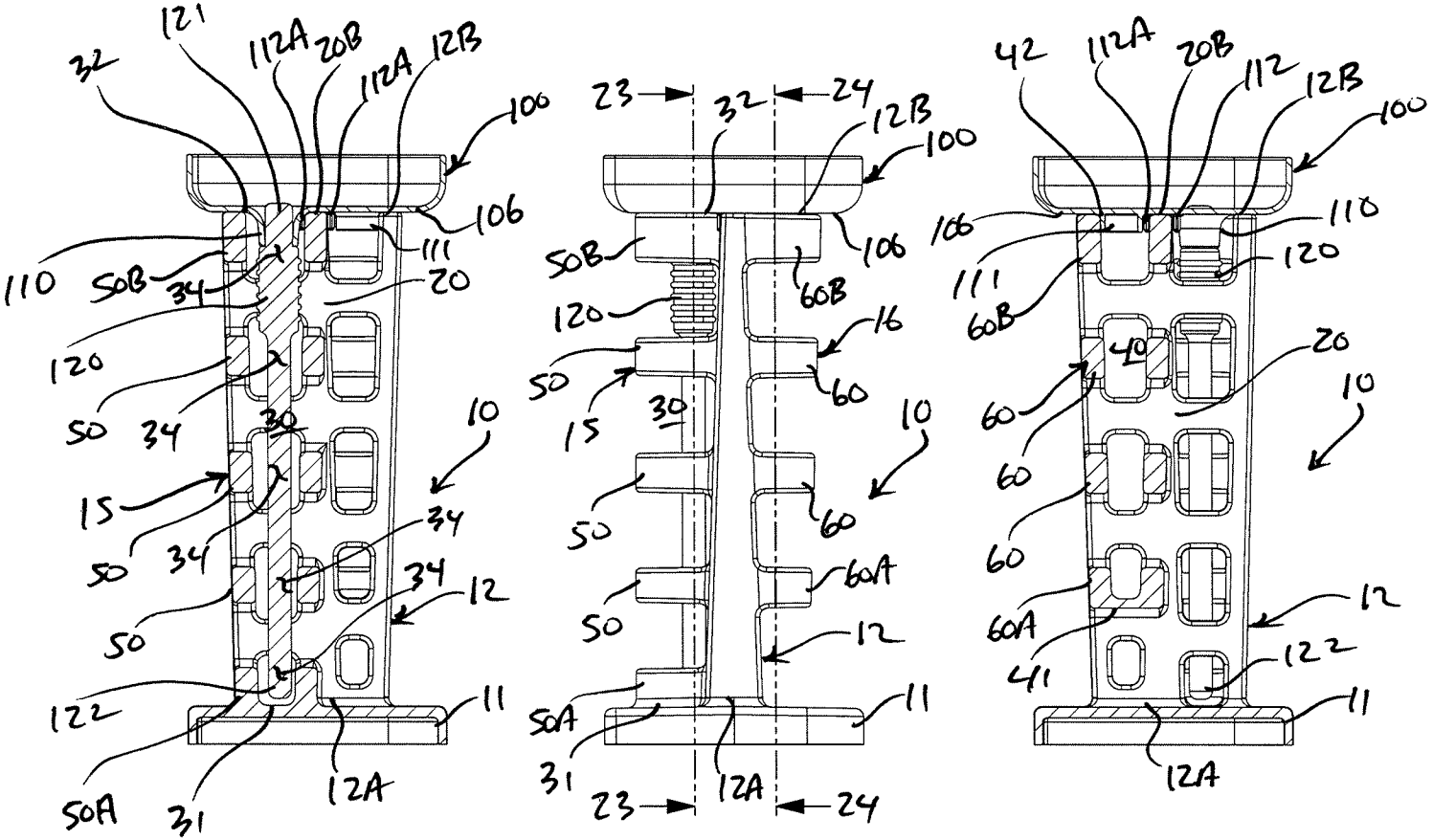
FIG. 22 is a left side elevation view of the cone-filling apparatus corresponding to FIG. 5 and the tray assembly of FIG. 8 as it would appear applied to the cone-filling apparatus in a stowage position, wherein the tray is positioned atop the cone-filling apparatus in a stowage position, the spout is inserted into the major cone holder, and the implement depends downwardly from the spout into the major cone holder.
FIG. 23 is a section view taken along line 23-23 of FIG. 22 illustrating the tray positioned atop the cone-filling apparatus in the stowage position, the spout of the tray inserted into the major cone holder, the implement depending downwardly into the major cone holder from the spout, and the catch of FIG. 11 engaging the cone-filling apparatus.
FIG. 24 is a section view taken along line 24-24 of FIG. 22 illustrating the tray positioned atop the cone-filling apparatus in the stowage position, the spout of the tray inserted into the major cone holder, the implement depending downwardly into the major cone holder from the spout, the catch of FIG. 11 engaging the cone-filling apparatus, and the pin of FIG. 11 inserted into the minor cone holder.

Bindings 50 are each concurrently connected to upright stanchion 20 and side stanchion 21. Each binding 50 is a U-shaped component including opposed parallel arms 55 connected by curved end wall 56 that bound a receiving area 34. Ends of the respective arms 55 of each binding 50 are connected to central stanchion 20 and side stanchion 21, respectively, and extend outwardly from front 12B of tower 12 to curved end wall 56. Lowermost binding 50A is connected directly atop, and extends upright from, base 11 in FIGS. 18, 20 and 23, which defines closed end 31.

Figure 21:
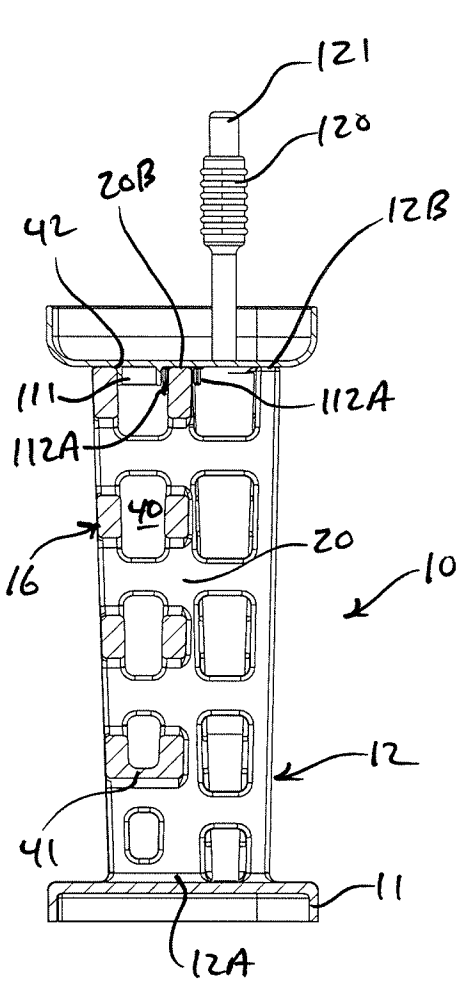
FIG. 21 is a section view taken along line 21-21 of FIG. 19 illustrating the major cone installed in the major cone holder of the cone-filling apparatus, the tray positioned atop the cone-filling apparatus in the major cone-filling position, the implement inserted into the major cone through the tray, the catch of FIG. 11 engaged to the cone-filling apparatus, and the pin of FIG. 11 inserted into the minor cone holder.

Bindings 60 are each concurrently connected to upright stanchion 20 and side stanchion 22. Each binding 60 is a U-shaped component including opposed parallel arms 65 connected by curved end wall 66 that bound a receiving area 44. Ends of the respective arms 65 of each binding 60 are connected to central stanchion 20 and side stanchion 22, respectively, and extend outwardly from back 12C of tower 12 to curved end wall 66. Lowermost binding 60A has a closed bottom that defines closed end 41 in FIGS. 17, 21, and 24.

Figures 14, 15:
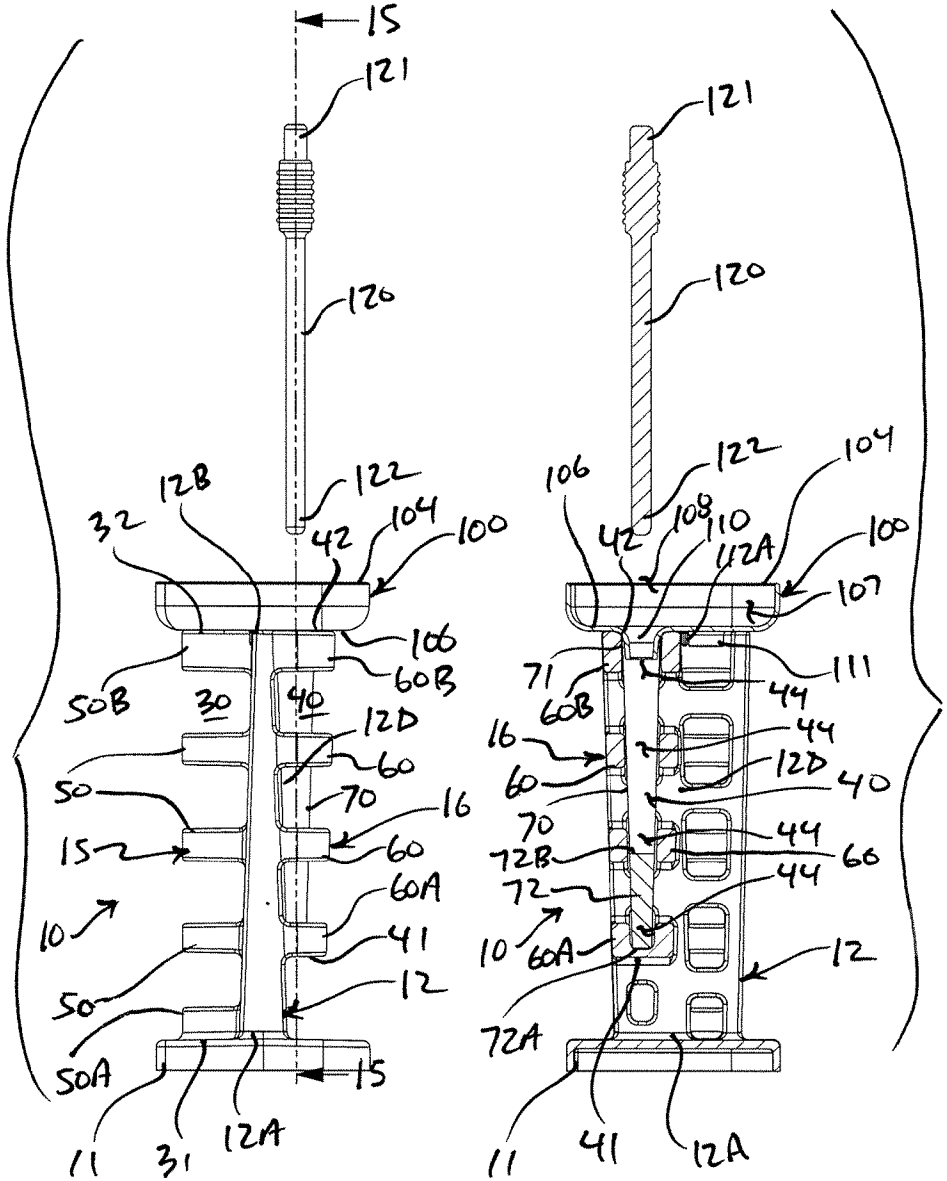
FIG. 14 is a left side elevation view of the embodiment of FIG. 13.
FIG. 15 is a section view taken along line 15-15 of FIG. 14.
Figures 16, 17, 18:
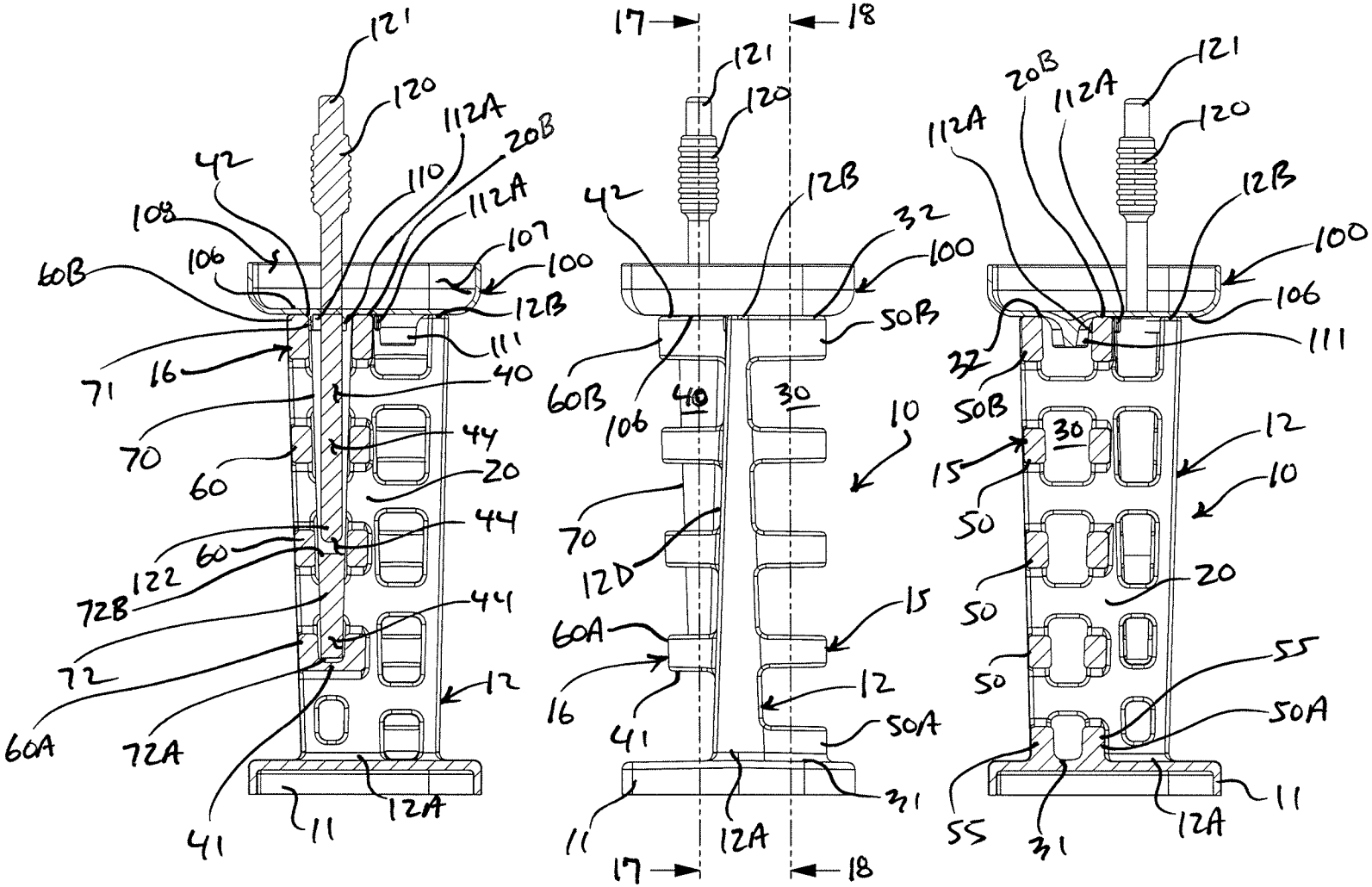
FIG. 16 is right side elevation corresponding to FIGS. 14 and 15 illustrating the implement inserted into the minor cone through the tray.
FIG. 17 is a section view taken along line 17-17 of FIG. 16 illustrating the minor cone installed in the minor cone holder of the cone-filling apparatus, the tray positioned atop the cone-filling apparatus in the minor cone-filling position, the spout of the tray inserted into the open end of the minor cone, the implement inserted into the minor cone through the open end of the minor cone and the spout of the tray illustrated in FIG. 11, and the catch of FIG. 11 engaged to the cone-filling apparatus.
FIG. 18 is a section view taken along line 18-18 of FIG. 16 illustrating the minor cone installed in the minor cone holder of the cone-filling apparatus, the tray positioned atop the cone-filling apparatus in the minor cone-filling position, the implement inserted into the minor cone through the tray, the catch of FIG. 11 engaged to the cone-filling apparatus, and the pin of FIG. 11 inserted into the major cone holder.
Figure 19:
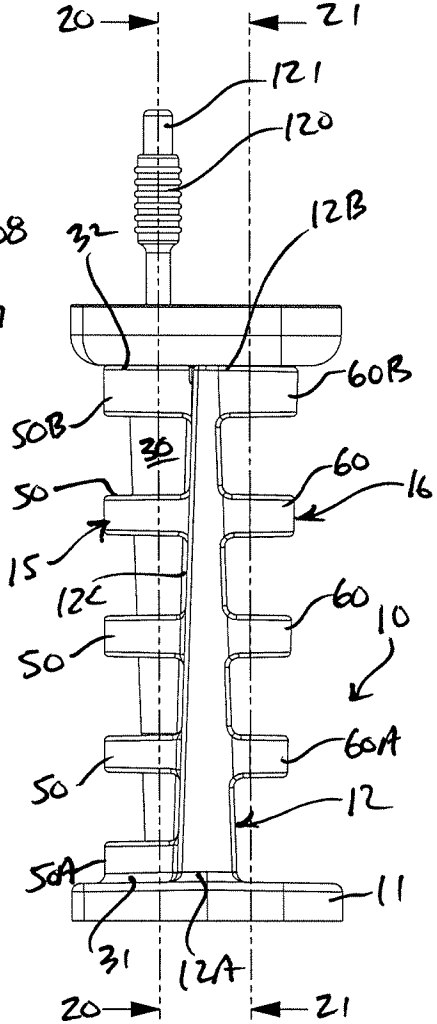
FIG. 19 is a left side elevation of the cone-filling apparatus of FIG. 1 illustrating a major cone installed within the major cone holder of the cone-filling apparatus, the tray positioned atop the cone-filling apparatus in a major cone-filling position for applying a material to be smoked into major cone through the open end of the major cone through the spout of the tray, and the implement of FIG. 9 inserted into the major cone through the tray.
Figure 20:
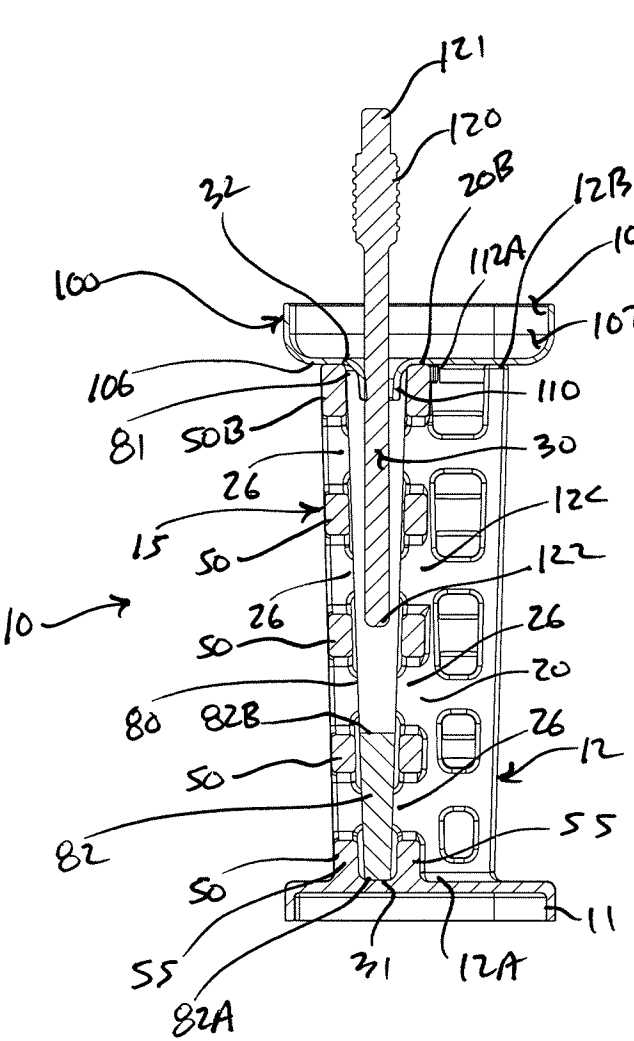
FIG. 20 is a section view taken along line 20-20 of FIG. 19 illustrating the major cone installed in the major cone holder of the cone-filling apparatus, the tray positioned atop the cone-filling apparatus in the major cone-filling position, the spout of the tray inserted into the open end of the major cone, the implement inserted into the major cone through the open end of the major cone and the spout of the tray illustrated in FIG. 11, and the catch of FIG. 11 engaged to the cone-filling apparatus.

Accordingly, the overall shape of cone holder 15 defined by the front of members 25 and receiving areas 34 of bindings 50 is designed to receive an inverted smoking cone 70 as shown in FIGS. 19 and 20. The length of the vertical distance of cone holder 15 from closed end 31 to open end 32 is chosen to relate to the overall length of the corresponding smoking cone 70. Further, the overall shape of cone holder 16 defined by the back of members 26 and receiving areas 44 of bindings 60 is designed to receive an inverted smoking cone 80 as shown in FIGS. 15-17. The length of the vertical distance of cone holder 16 from closed end 41 to open end 42 is chosen to relate to the overall length of the corresponding smoking cone 80.

Figure 8:
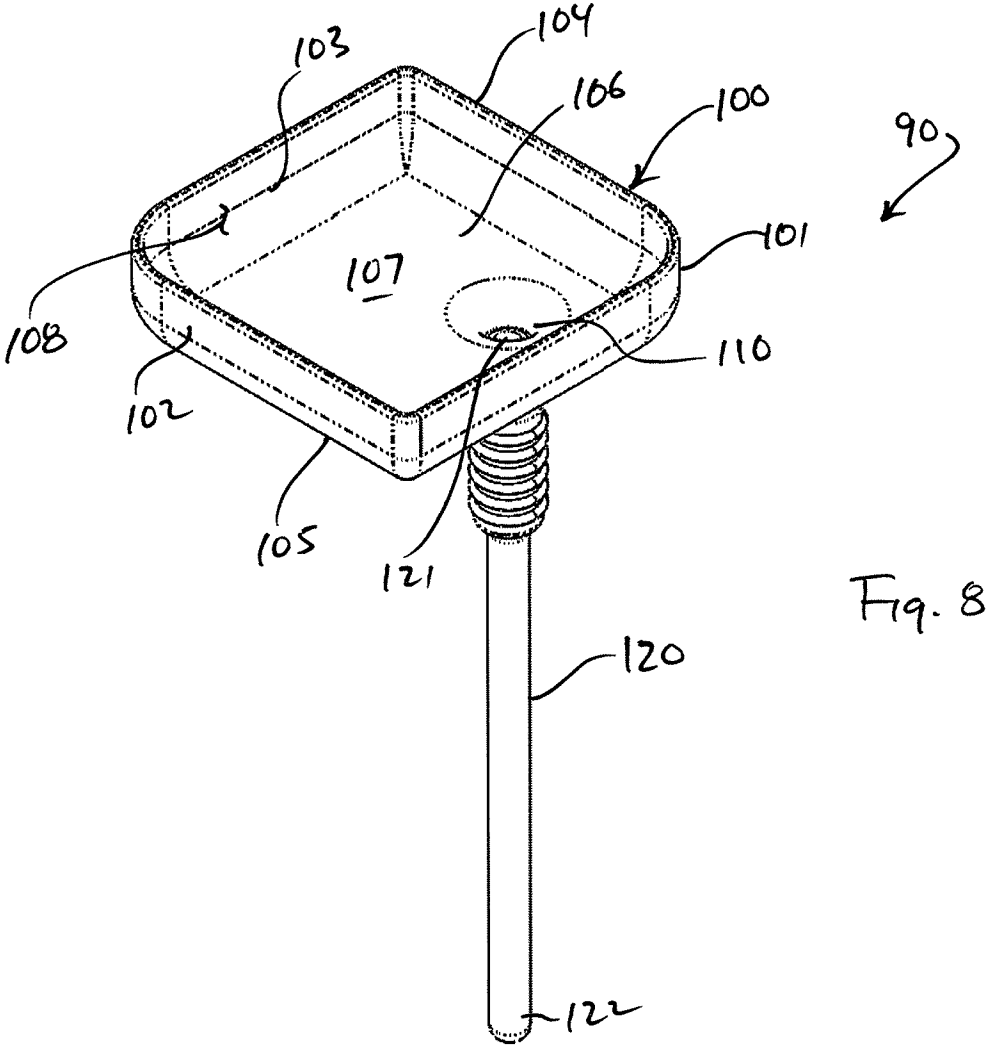
FIG. 8 is a perspective view of a tray assembly including an implement connected to, and depending downwardly from, a spout of a tray.
Figure 9:
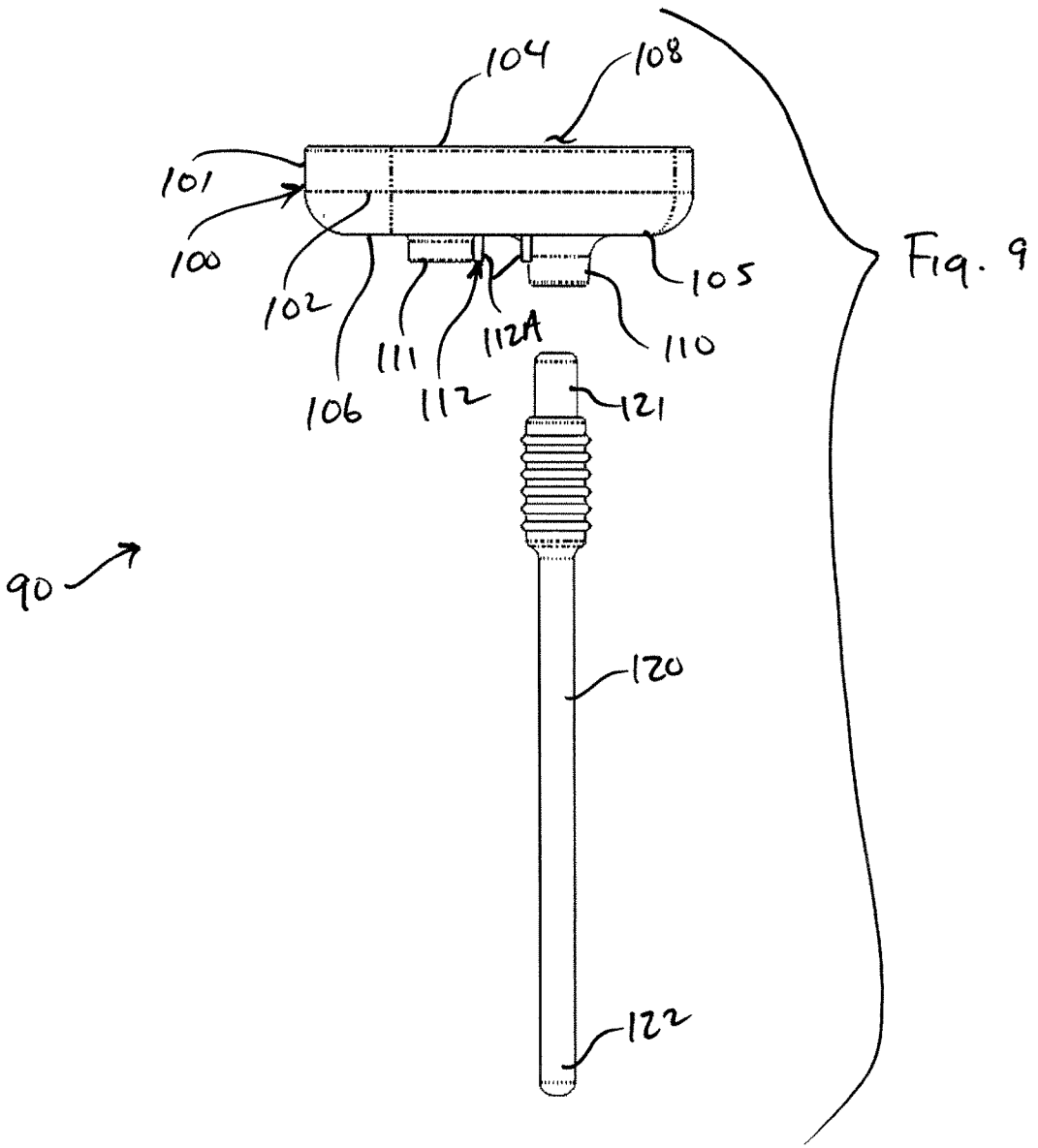
FIG. 9 is a side elevation view of the embodiment of FIG. 8 illustrating the implement detached from the tray.
Figure 10:
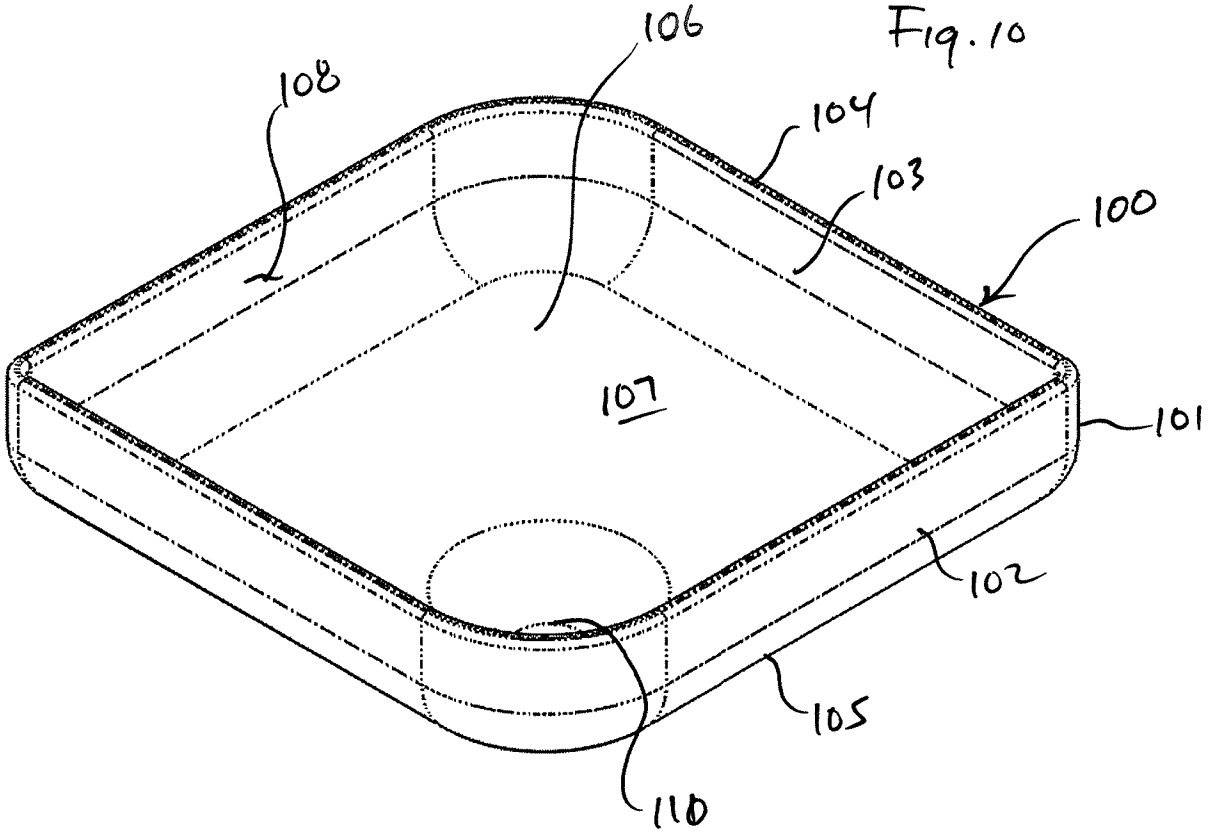
FIG. 10 is a top perspective view of the tray of FIG. 9.
Figure 11:
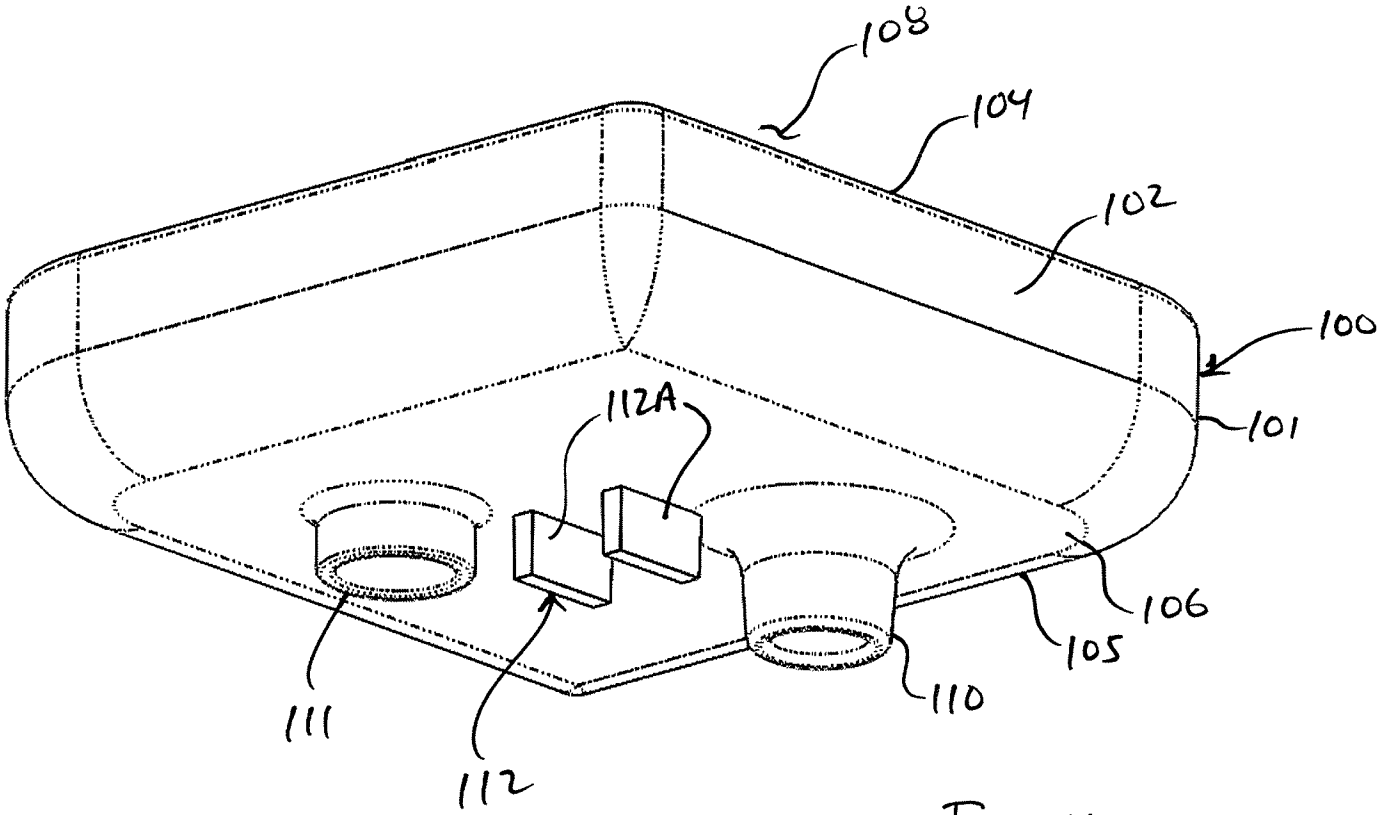
FIG. 11 is a bottom perspective view of the tray of FIG. 9, the tray including the spout of FIG. 8 and a pin on either side of a catch.

FIG. 8 illustrates a tray assembly 90, including tray 100 and implement 120. Referring to FIGS. 8-11 in relevant part, tray 100, a container, includes continuous sidewall 101 having outer surface 102, inner surface 103, upper edge 104, and lower edge 105. Horizontal bottom 106 is affixed to lower edge 105. Bottom 106 cooperates with inner surface 103 of continuous sidewall 101 to form volume 107. Upper edge 104 encircles opening 108 to volume 107. Volume 107 is for receiving contents, such as tobacco or herbs for smoking, placed therein through opening 108.

Tray includes spout 110, pin 111, and catch 112 that extend outwardly from bottom 106. Spout 110 is formed through bottom 106 and extends outwardly from bottom 106. Catch 112, a notch formed by opposed parallel walls 112A, is centrally positioned, and spout 110 and pin 111 are positioned on either side of catch 112.

Implement 120 is an elongate shaft having opposed inner and outer ends 121 and 122. Implement 120 can be attached to tray 110 by pressing inner end 121 into spout 110 from the outer side of bottom 106, as in FIG. 8. When inner end 121 is friction fit into spout 110, implement 120 depends downwardly from inner end 121 fitted into spout 110 to outer end 122. Implement 120 can be detached from spout 110 for separating implement 120 from tray 110 in FIG. 9 by pulling apart implement 120 from tray 110 by hand.

Figure 12:
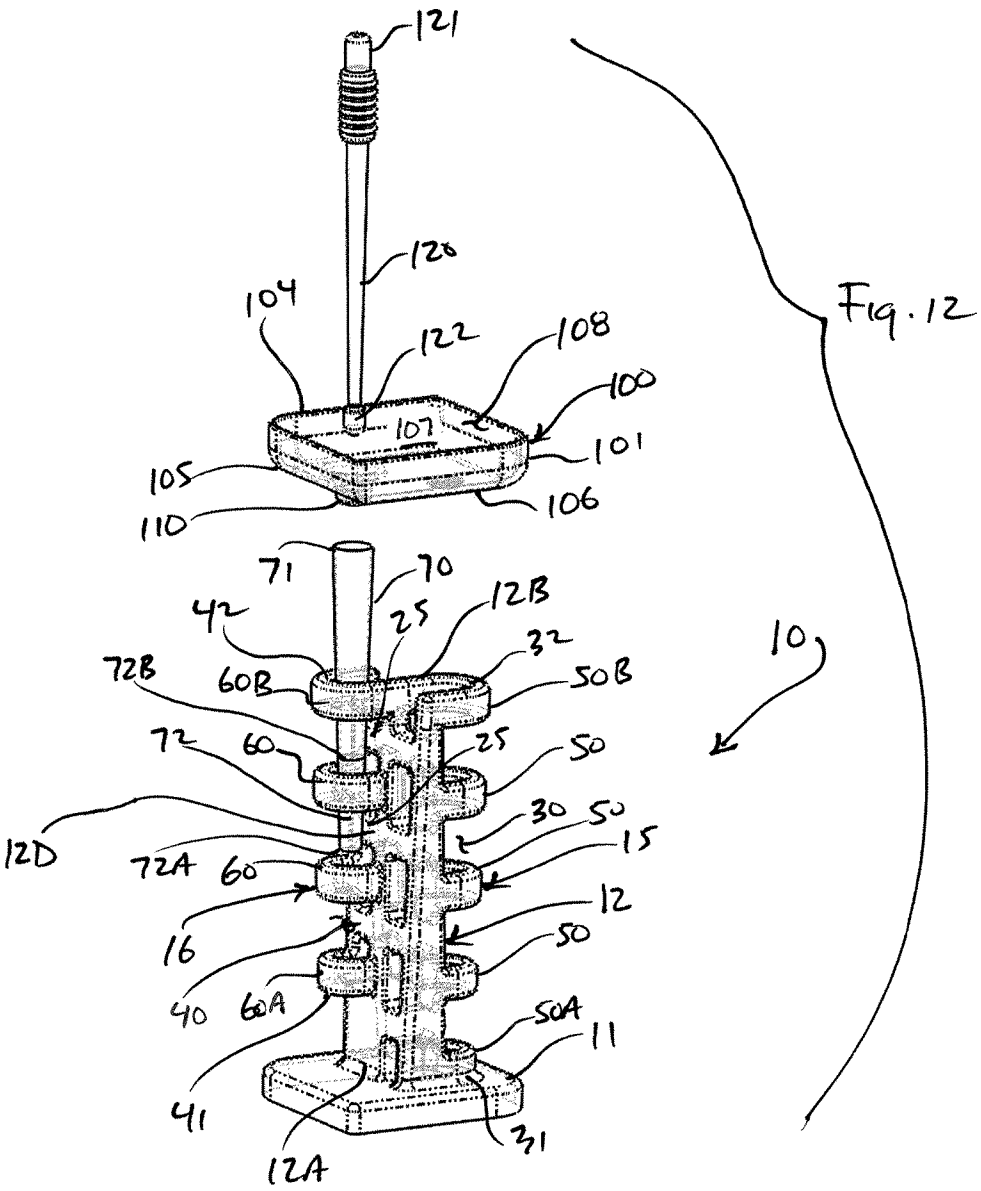
FIG. 12 is a perspective view of the cone-filling apparatus of FIG. 1 and tray and the implement of FIG. 9, wherein the implement is positioned above and is aligned axially with the spout of the tray, and the spout of the tray is aligned axially with an open end of a minor cone installed partially within the minor cone holder of the cone-filling apparatus.
Figure 13:
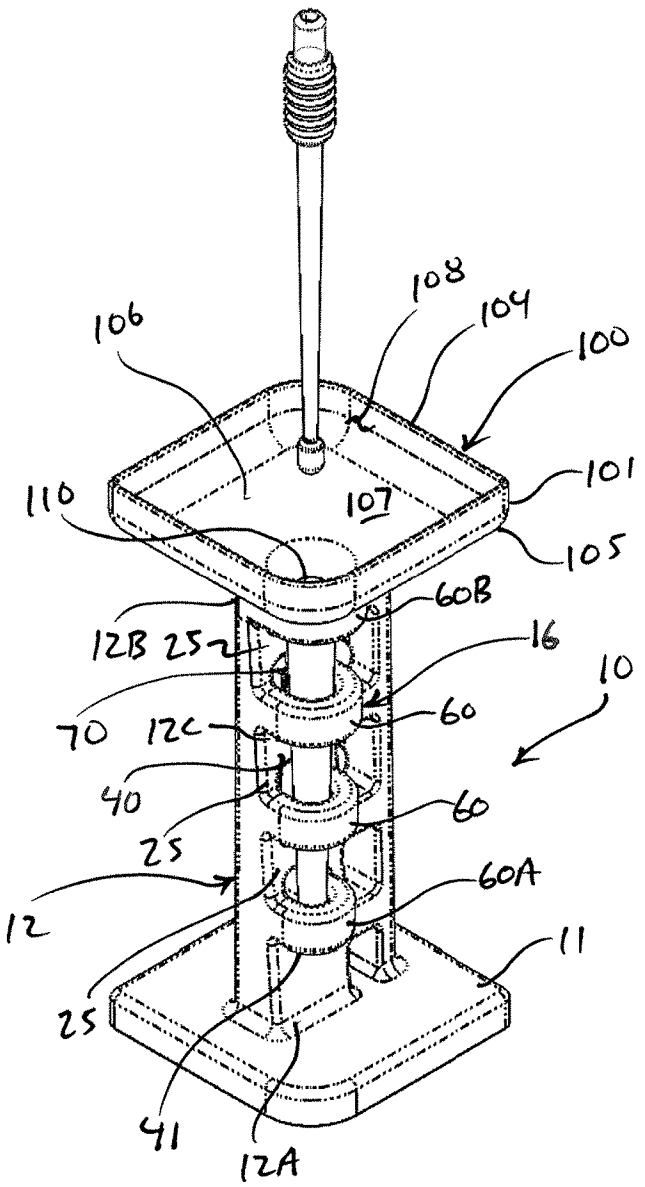
FIG. 13 is a perspective view corresponding to FIG. 12 illustrating the minor cone installed within the minor cone holder of the cone-filling apparatus, the tray positioned atop the cone-filling apparatus in a minor cone-filling position for applying a material to be smoked into the minor cone through the open end of the minor cone through the spout of the tray, and the implement positioned above and aligned axially with the spout and the open end of the minor cone.

FIG. 12 illustrates smoking cone 70. Smoking cone 70 tapers from open circular section 71 to pointed end 72A of filter 72. In this example, the length of smoking cone 70 from pointed end 72A to open circular section 71 corresponds to the length of volume 40 of cone holder 16. Cone 70 is inverted and inserted filtered end 72 first into volume 40 through open end 42 in FIG. 12 until pointed end 72A of filter 72 comes to rest against closed end 41 of volume 40 in FIG. 17 defined by lowermost binder 60A. In FIG. 17, filter 72 extends upright from pointed end 72A at lowermost binding 60A to its distal end 72B into the receiving area 44 of the next adjacent binder 60, which supports cone 70 from buckling at the junction between distal end 72B of filter 72 and the material of cone 70, which is normally paper. Binders 60 axially spaced apart vertically along the length of cone 70 from filter 72 to open circular section 71 support cone 70 against forces exerted outwardly from the interior of cone 70 when cone 70 is filled conveniently while held inverted by cone holder 16 of apparatus 10 with material to be smoked through open circular section 71 and open end 42 of volume 40. After cone 70 is filled with material to be smoked through open circular section 71, the filled cone 70 is withdrawn from cone holder 16, and open circular section 71 is tied off or otherwise sealed. The filled cone 70 may then be smoked in the normal manner. This process is repeated for each subsequent cone.

To fill cone 70 with the use of tray 100 and implement 120, tray 100 and implement 120 are separated from one another as in FIG. 12 and tray 100 is set atop upper extremity 12B of tower 12 in FIGS. 13-18 in a minor cone filling position, in which spout 110 extends into open end 42 of cone holder 16 and into open circular section 71 of cone 70 in FIGS. 15 and 16, pin 111 extends into open end 32 of cone holder 15 in FIG. 18, and parallel walls 112A of catch 112 engage either side of upper end 20B of central stanchion 20 of upper extremity 12B of tower 12 restricting rotation of tray 100 relative to tower 12. When tray 110 is set atop upper extremity 12B of tower 12 in the described minor cone-filling position, the material to be smoked may be applied into volume 107 of tray 100 through opening 108, and inner end 121 of implement 120 may be taken up by hand and used to coax the material to spout 110 and into cone 70 through open circular section 71 through spout 110. By holding outer end 121 of implement 120 by hand, the user may insert outer end 122 of implement 120 into cone 70 in FIG. 17 through open circular section 71 and spout 110 to pack the material to be smoked in cone 70. The process of applying and packing the material to be smoked with tray 100 and implement 120 is continued until cone 70 is filled to a preselected level or with a preselected amount of the material to be smoked. After cone 70 is filled with material to be smoked through open circular section 71, tray 100 and implement 120 are withdrawn, the filled cone 70 is withdrawn from cone holder 16 of apparatus 10, and open circular section 71 is tied off or otherwise sealed. The filled cone 70 may then be smoked in the normal manner. This process is repeated for each subsequent cone.

FIG. 20 illustrates smoking cone 80. Smoking cone 80 tapers from open circular section 81 to pointed end 82A of filter 82. In this example, the length of smoking cone 80 from pointed end 82A to open circular section 81 corresponds to the length of volume 30 of cone holder 15. Cone 80 is inverted and inserted filtered end 82 first into volume 30 of cone holder 15 through open end 32 in FIG. 20 until pointed end 82A of filter 82 comes to rest against closed end 31 of volume 30 in FIG. 20 defined by lowermost binder 50A. In FIG. 20, filter 82 extends upright from pointed end 82A at lowermost binding 50A to its distal end 82B into the receiving area 34 of the next adjacent binder 50, which supports cone 80 from buckling at the junction between distal end 82B of filter 82 and the material of cone 80, which is normally paper. Binders 50 axially spaced apart vertically along the length of cone 80 from filter 82 to open circular section 81 support cone 80 against forces exerted outwardly from the interior of cone 80 when cone 80 is filled conveniently while held inverted by cone holder 15 of apparatus 10 with material to be smoked through open circular section 81 and open end 32 of volume 30. After cone 80 is filled with material to be smoked through open circular section 81, the filled cone 80 is withdrawn from cone holder 15 of apparatus 10, and open circular section 81 is tied off or otherwise sealed. The filled cone 80 may then be smoked in the normal manner. This process is repeated for each subsequent cone.

To fill cone 80 with the use of tray 100 and implement 120, tray 100 and implement 120 are separated from one another and tray is set atop upper extremity 12B of tower 12 in FIGS. 13-18 in a major cone filling position, in which spout 110 extends into open end 32 of cone holder 15 and into open circular section 81 of cone 80 in FIG. 20, pin 111 extends into open end 42 of cone holder 16 in FIG. 18, and parallel walls 112A of catch 112 engage either side of upper end 20B of central stanchion 20 of upper extremity 12B of tower 12 restricting rotation of tray 100 relative to tower 12. When tray 110 is set atop upper extremity 12B of tower 12 in the described major cone-filling position, the material to be smoked may be applied into volume 107 of tray 100 through opening 108, and inner end 121 of implement 120 may be taken up by hand and used to coax the material to spout 110 and into cone 80 through open end 32 and open circular section 81 through spout 110. By holding outer end 121 of implement 120 by hand, the user may insert outer end 122 of implement 120 into cone 80 in FIG. 20 through open circular section 81 and spout 110 to pack the material to be smoked in cone 80. The process of applying and packing the material to be smoked with tray 100 and implement 120 is continued until cone 80 is filled to a preselected level or with a preselected amount of the material to be smoked. After cone 80 is filled with material to be smoked through open end 32 and open circular section 81, tray 100 and implement 120 are withdrawn, the filled cone 80 is withdrawn from cone holder 15 of apparatus 10, and open circular section 81 is tied off or otherwise sealed. The filled cone 80 may then be smoked in the normal manner. This process is repeated for each subsequent cone.

During periods of non-use, tray assembly 90 may be assembled as in FIG. 8 and applied to apparatus 10 in a stowage position. In the stowage position of tray assembly 90 relative to apparatus 10, tray 100 is positioned atop upper extremity 12B of tower 12 in a stowage position in FIGS. 22-24, in which spout 110 is inserted into open end 32 of cone holder 15 in FIG. 23, implement 120 extends outer end 122 first into volume 30 through open end 32 and depends downwardly from spout 110 and through open end 32 and into volume 30 to outer end 122 proximate to closed end 31 in FIG. 23, pin 111 extends into open end 42 of cone holder 16 in FIG. 24, and parallel walls 112A of catch 112 engage either side of upper end 20B of central stanchion 20 of upper extremity 12B of tower 12 restricting rotation of tray 100 relative to tower 12. In this stowage position of tray assembly 90 relative to apparatus 10, the entire assembly may be conveniently stored until it is needed again for further use.

Apparatus 10 is formed of plastic, metal or other material or combination of materials having inherently strong, rigid, and impact resistant material characteristics. Apparatus 10 is preferably integrally formed via molding or machining, and can be formed of a plurality of parts attached together via welding, heat bonding, adhesive, fasteners, etc.

The present invention is described above with reference to illustrative embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. An apparatus for filling smoking cones, comprising:

a base;

a tower includes a lower extremity and an upper extremity, the tower projects upright from the lower extremity affixed to the base to the upper extremity;

a first cone holder coupled to the tower, the first cone holder defines a first inverted cone-receiving volume that extends upright from a closed end of the first cone holder proximate to the lower extremity of the tower to an open end of the first cone holder proximate to the upper extremity of the tower;

a second cone holder coupled to the tower, the second cone holder defines a second inverted cone-receiving volume that extends upright from a closed end of the second cone holder between the lower extremity of the tower and the upper extremity of the tower to an open end of the second cone holder proximate to the upper extremity of the tower;

a first length of the first inverted cone-receiving volume from the closed end of the first cone holder to the open end of the first cone holder;

a second length of the second inverted cone-receiving volume from the closed end of the second cone holder to the open end of the second cone holder;

the first length is greater than the second length;

the first cone holder comprises bindings, the bindings project outward from the tower, are spaced apart, and are axially aligned vertically from the closed end of the first cone holder to the open end of the first cone holder;

a lowermost one of the bindings proximate to the lower extremity of the tower defines the closed end of the first cone holder;

an uppermost one of the bindings proximate to the upper extremity of the tower defines the open end of the first cone holder;

each of the bindings bounds a receiving area;

the receiving areas are axially aligned vertically from the closed end of the first cone holder to the open end of the first cone holder; and the receiving areas bound by the bindings and the tower extending between each binding and an adjacent binding together define the first inverted cone-receiving volume from the closed end of the first cone holder to the open end of the first cone holder.

2. The apparatus according to claim 1, wherein the receiving areas enlarge progressively from the lowermost one of the bindings to the uppermost one of the bindings.

3. The apparatus according to claim 1, wherein the bindings are parallel relative to each other.

4. The apparatus according to claim 1, wherein the bindings project outwardly from the tower.

5. The apparatus according to claim 1, wherein the bindings are U-shaped.

6. The apparatus according to claim 1, further comprising:

a tray, the tray includes a spout and a pin on either side of a catch;

the spout extends into the open end of the first cone holder, the pin extends into the open end of the second cone holder, and the catch engages the upper extremity of the tower restricting rotation of the tray relative to the tower, when the tray is set atop the upper extremity of the tower in a first cone-filling position; and the spout extends into the open end of the second cone holder, the pin extends into the open end of the first cone holder, and the catch engages the upper extremity of the tower restricting rotation of the tray relative to the tower, when the tray is set atop the upper extremity of the tower in a second cone-filling position.

7. An apparatus for filling smoking cones, comprising:

a base;

a tower includes a lower extremity and an upper extremity, the tower projects upright from the lower extremity affixed to the base to the upper extremity;

a first cone holder coupled to the tower, the first cone holder defines a first inverted cone-receiving volume that extends upright from a closed end of the first cone holder proximate to the lower extremity of the tower to an open end of the first cone holder proximate to the upper extremity of the tower;

a second cone holder coupled to the tower, the second cone holder defines a second inverted cone-receiving volume that extends upright from a closed end of the second cone holder between the lower extremity of the tower and the upper extremity of the tower to an open end of the second cone holder proximate to the upper extremity of the tower;

a first length of the first inverted cone-receiving volume from the closed end of the first cone holder to the open end of the first cone holder;

a second length of the second inverted cone-receiving volume from the closed end of the second cone holder to the open end of the second cone holder;

the first length is greater than the second length;

the second cone holder comprises bindings, the bindings project outward from the tower, are spaced apart, and are axially aligned vertically from the closed end of the second cone holder to the open end of the second cone holder;

a lowermost one of the bindings between the lower extremity of the tower and the upper extremity of the tower defines the closed end of the second cone holder;

an uppermost one of the bindings proximate to the upper extremity of the tower defines the open end of the second cone holder;

each of the bindings bounds a receiving area;

the receiving areas are axially aligned vertically from the closed end of the second cone holder to the open end of the second cone holder; and the receiving areas bound by the bindings and the tower extending between each binding and an adjacent binding together define the second inverted cone-receiving volume from the closed end of the second cone holder to the open end of the second cone holder.

8. The apparatus according to claim 7, wherein the receiving areas enlarge progressively from the lowermost one of the bindings to the uppermost one of the bindings.

9. The apparatus according to claim 7, wherein the bindings are parallel relative to each other.

10. The apparatus according to claim 7, wherein the bindings project outwardly from the tower.

11. The apparatus according to claim 7, wherein the bindings are U-shaped.

12. The apparatus according to claim 7, further comprising:

a tray, the tray includes a spout and a pin on either side of a catch;

the spout extends into the open end of the first cone holder, the pin extends into the open end of the second cone holder, and the catch engages the upper extremity of the tower restricting rotation of the tray relative to the tower, when the tray is set atop the upper extremity of the tower in a first cone-filling position; and the spout extends into the open end of the second cone holder, the pin extends into the open end of the first cone holder, and the catch engages the upper extremity of the tower restricting rotation of the tray relative to the tower, when the tray is set atop the upper extremity of the tower in a second cone-filling position.

* * * * *